US007564437B2

(12) United States Patent
Yokoyama et al.

(10) Patent No.: US 7,564,437 B2
(45) Date of Patent: Jul. 21, 2009

(54) LIQUID CRYSTAL DISPLAY DEVICE AND CONTROLLING METHOD THEREOF

(75) Inventors: Ryoichi Yokoyama, Ogaki (JP); Koji Hirosawa, Ichinomiya (JP)

(73) Assignee: Sanyo Electric Co., Ltd., Osaka (JP)

( * ) Notice: Subject to any disclaimer, the term of this patent is extended or adjusted under 35 U.S.C. 154(b) by 665 days.

(21) Appl. No.: 11/074,942

(22) Filed: Mar. 9, 2005

(65) Prior Publication Data

US 2005/0212743 A1 Sep. 29, 2005

(30) Foreign Application Priority Data

Mar. 10, 2004 (JP) ..... 2004-067895

(51) Int. Cl.
*G09G 3/36* (2006.01)

(52) U.S. Cl. ..... 345/87; 345/94

(58) Field of Classification Search ..... 345/87–104
See application file for complete search history.

(56) References Cited

U.S. PATENT DOCUMENTS 5,748,169 A * 5/1998 Okumura et al. ..... 345/100
7,068,292 B2 * 6/2006 Morita ..... 345/690
2003/0038768 A1 * 2/2003 Sakashita ..... 345/87

OTHER PUBLICATIONS

Yasoji Suzuki (1998) "Introduction to Liquid Crystal Display Engineering," published by Nikkan Kogyo Shimbun, Ltd., pp. 101-103.

* cited by examiner

*Primary Examiner*—Henry N Tran
*Assistant Examiner*—Kenneth B Lee, Jr.
(74) *Attorney, Agent, or Firm*—Morrison & Foerster LLP

(57) ABSTRACT

This invention provides a liquid crystal display device where an excellent display can be obtained by using a supplemental capacitance coupling driving method. When at least either one of voltages of a pixel electrode for a common electrode before or after a potential of a supplemental capacitance line is changed lies within a transition region R as a region of voltages which largely change a liquid crystal capacitance $C_{LC}$, correction of an image signal is performed by adding a changing amount of the potential of the pixel electrode by using $C_{ALL}$ added with $C_{LC}$ after changed. This is because that $C_{LC}$ as one of components of $C_{ALL}$ in an amount $(C_{SC}/C_{ALL})\times\Delta V$ of the potential change of the pixel electrode caused by the potential change of the supplemental capacitance line changes.

14 Claims, 7 Drawing Sheets

LIQUID CRYSTAL DISPLAY DEVICE AND CONTROLLING METHOD THEREOF

CROSS-REFERENCE OF THE INVENTION

This invention is based on Japanese Patent Application No. 2004-067895, the content of which is incorporated by reference in its entirety.

BACKGROUND OF THE INVENTION

1. Field of the Invention

The invention relates to a display device, particularly to a display device having a pixel portion.

2. Description of the Related Art

In a liquid crystal display device, when a DC voltage is kept applied to a liquid crystal of a pixel portion for a long time, a lag phenomenon called "burn-in" occurs. Therefore, the liquid crystal display device need use a driving method of inversing a potential of a pixel electrode relative to a potential of a common electrode in a predetermine cycle. One of such driving methods of the liquid crystal display device is a DC driving method of applying a DC voltage to the common electrode. As this DC driving method, a line inversion driving method of inverting the pixel potential relative to a potential of the common electrode to be applied with a DC voltage in each of horizontal periods has been known. This technology is proposed in "Introduction to liquid crystal display engineering," pp. 101-103, written by Yasoji Suzuki and published by the Nikkan Kogyo Shimbun, Ltd., at Nov. 20, 1998. It is noted that one horizontal period means a period of writing an image signal to all the pixel portions arrayed along one gate line.

FIG. 7 shows a waveform chart in a case where a liquid crystal display device is driven by using a conventional line inversion driving method. When the liquid crystal display device is driven by using the conventional line inversion driving method in FIG. 7, image signals are inverted relative to a potential COM of a common electrode in each of the horizontal periods. Each of the image signals is changed in each of pixel portions A to F according to an image to be displayed.

A liquid crystal display device using a dot inversion driving method of inverting each of image signals relative to a potential COM of a common electrode in each of adjacent pixel portions A to F has been proposed, too.

FIG. 8 is a waveform chart in a case where a liquid crystal display device is driven by using the conventional dot inversion driving method. When the liquid crystal display device is driven by using the conventional dot inversion driving method, different from the conventional line inversion driving method shown in FIG. 7, each of the image signals corresponding to the image to be displayed is inverted relative to the potential COM of the common electrode in each of the pixel portions A to F.

In the conventional driving methods described above, however, since a curve of transmittances of a liquid crystal layer relative to image signal voltages is highly steep as shown in FIG. 9, increasing grayscales largely narrows each of intervals between voltages to be applied to a liquid crystal for realizing the grayscales. That is, each of changing amounts of transmittances relative to the voltages (image signal voltages) is large, so that it has been difficult to realize a smooth grayscale image.

SUMMARY OF THE INVENTION

The invention provides a liquid crystal display device that includes a plurality of drain lines, a plurality of gate lines arranged substantially normal to the drain lines, a plurality of pixel electrodes connected to corresponding drain lines, a common electrode, a liquid crystal layer disposed between the pixel electrodes and the common electrode, and a plurality of supplemental capacitors each provided for corresponding pixel electrodes. Each of the supplemental capacitors includes a first electrode connected to a corresponding pixel electrode and a second electrode. The device also includes a plurality of supplemental capacitance lines each connected to corresponding second electrodes and configured to receive supplemental voltages, and a correction circuit correcting image signals supplied to the pixel electrodes through the drain lines and the supplemental capacitors when a start voltage that is a voltage of a pixel electrode at a start of receiving a supplemental voltage or an end voltage that is a voltage of the pixel electrode at an end of receiving the supplemental voltage falls within a range of voltage applied to the pixel electrode that corresponds to a change in a capacitance of the liquid crystal.

The invention also provides a method of controlling a liquid crystal display device. The method includes providing a liquid crystal display device that includes a gate line, a first pixel electrode and a second pixel electrode connected to the gate line, a common electrode, a liquid crystal layer disposed between the first and second pixel electrodes and the common electrode, a first supplemental capacitor provided for the first pixel electrode, a second supplemental capacitor provided for the second pixel electrode, a first supplemental capacitance line connected to the first supplemental capacitor and configured to receive a first supplemental voltage, and a second supplemental capacitance line connected to the second supplemental capacitor and configured to receive a second supplemental voltage. supplying the first supplemental voltage to the first supplemental capacitance line after completion of applying an image signal to the first pixel electrode. The method also includes supplying the second supplemental voltage to the second supplemental capacitance line after completion of applying another image signal to the second pixel electrode, and performing gamma correction to the another image signal based on a transmittance characteristic of the liquid crystal layer observed during the supplying of the first supplemental voltage.

DETAILED DESCRIPTION OF THE INVENTION

Embodiments of the invention will be described with reference to the drawings.

Figure 1:
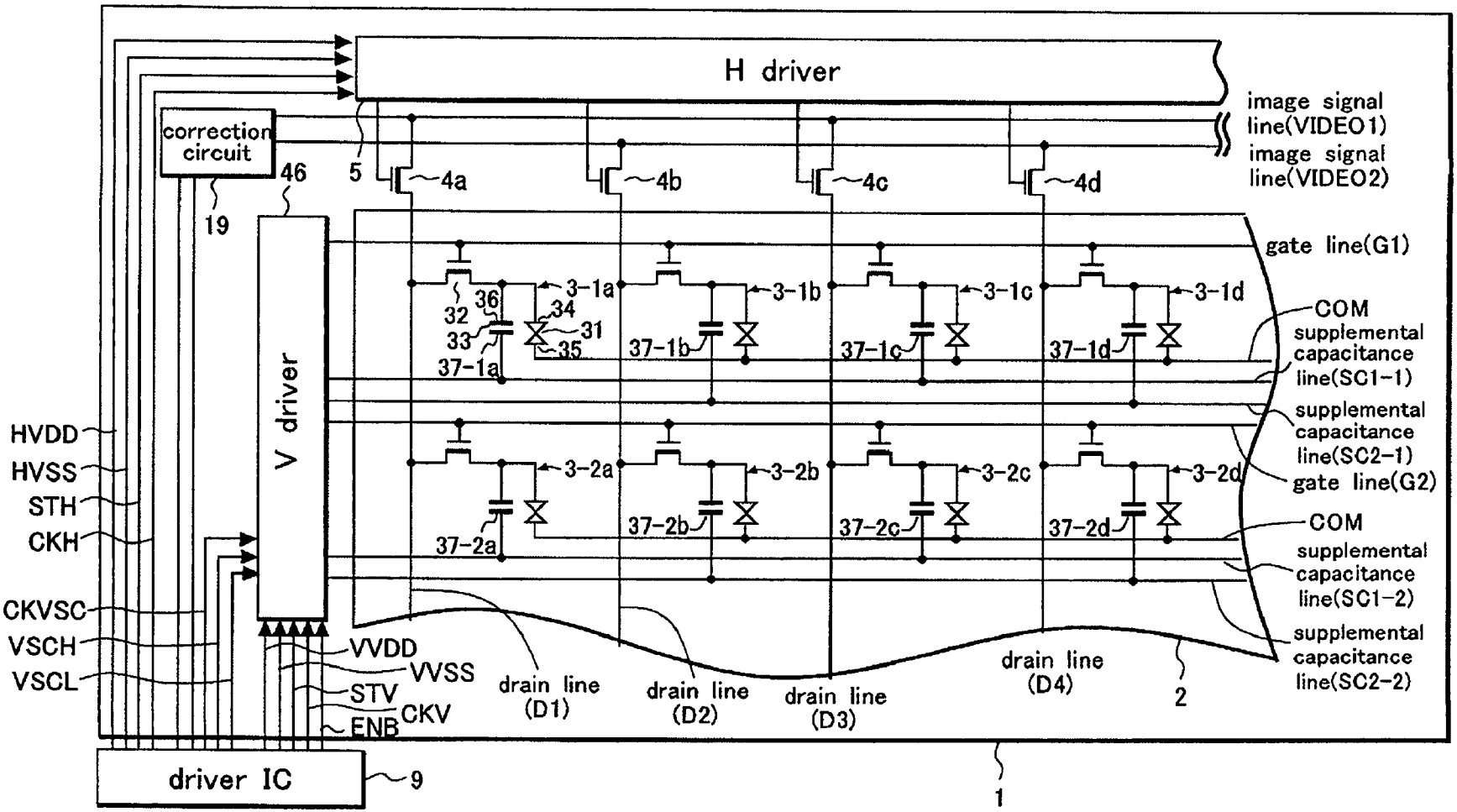
FIG. 1 is a plan view of a liquid crystal display device of a first embodiment of the invention.

FIG. 1 is a plan view of a liquid crystal display device of a first embodiment of the invention. A display portion 2 is provided on a substrate 1. Pixel portions 3-1*a* to 3-1*d*, 3-2*a* to 3-2*d* are arrayed on the display portion 2. FIG. 1 shows a matrix of two rows and four columns formed of two gate lines G1 and G2, four drain lines D1 to D4 crossing the gate lines G1 and G2, and eight pixel portions 3-1*a* to 3-1*d* and 3-2*a* to 3-2*d*, for simplifying the drawing. In fact, a plurality of gate lines and a plurality of drain lines are arrayed crossing each other, and a plurality of pixel portions is arrayed in a matrix of m rows and n columns.

Each of the pixel portions 3-1*a* to 3-1*d* and 3-2*a* to 3-2*d* includes a liquid crystal layer 31, a transistor 32, and a supplemental capacitance 33. The liquid crystal layer 31 is provided between a pixel electrode 34 and a common electrode 35.

Drains of the transistors 32 in the pixel portions 3-1*a* and 3-2*a* are connected with the drain line D1, and drains of the transistors 32 in the pixel portions 3-1*b* and 3-2*b* are connected with the drain line D2. In similar manners, drains of the transistors 32 in the pixel portions 3-1*c* and 3-2*c* are connected with the drain line D3, and drains of the transistors 32 in the pixel portions 3-1*d* and 3-2*d* are connected with the drain line D4. Sources in all the pixel portions are connected with the pixel electrodes 34, respectively.

One electrode 36 of the supplemental capacitance 33 in each of the pixel portions is connected with the pixel electrode 34. Another electrodes 37-1*a* and 37-1*c* of the supplemental capacitance 33 in the pixel portions 3-1*a* to 3-1*c* are connected with the supplemental capacitance line SC1-1, and another electrodes 37-1*b* and 37-1*d* of the supplemental capacitance 33 in the pixel portions 3-1*b* and 3-1*d* are connected with the supplemental capacitance line SC2-1. In similar manners, another electrodes 37-2*a* and 37-2*c* of the supplemental capacitance 33 in the pixel portions 3-2*a* and 3-2*c* are connected with the supplemental capacitance line SC1-2, and another electrodes 37-2*b* and 37-2*d* of the supplemental capacitance 33 in the pixel portions 3-2*b* and 3-2*d* are connected with the supplemental capacitance line SC2-2.

Furthermore, H switches (n-channel transistor) 4*a* to 4*d* for driving (scanning) the drain lines D1 to D4 and drain lines in five or more columns (not shown) and an H driver 5 are provided on the substrate 1. The H switch 4*a* corresponding to the pixel portion 3-1*a* (drain line D1) is connected with an image signal line VIDEO 1, and the H switch 4*b* corresponding to the pixel portion 3-1*b* (drain line D2) is connected with an image signal line VIDEO2. Although the H switch denotes an H switch in this embodiment, the H switch can be a transfer gate formed of an H switch and a p-channel transistor or other means.

Furthermore, a V driver 46 for driving (scanning) the gate line G1 in the first row, the gate line G2 in the second row, and gate lines in the third or more rows (not shown in FIG. 1) is provided on the substrate 1.

A drive IC 9 is provided outside the substrate 1. This drive IC 9 supplies a positive potential HVDD, a negative potential HVSS, a start signal STH, and a clock signal CKH to the H driver 5. The IC 9 supplies a positive potential VVDD, a negative potential VVSS, a start signal STV, a clock signal CKV, and an enable signal ENB to the V driver 46. The IC 9 supplies a positive potential VSCH, a negative potential VSCL, and a clock signal CKVSC to a potential supply circuit 7.

Figure 2:
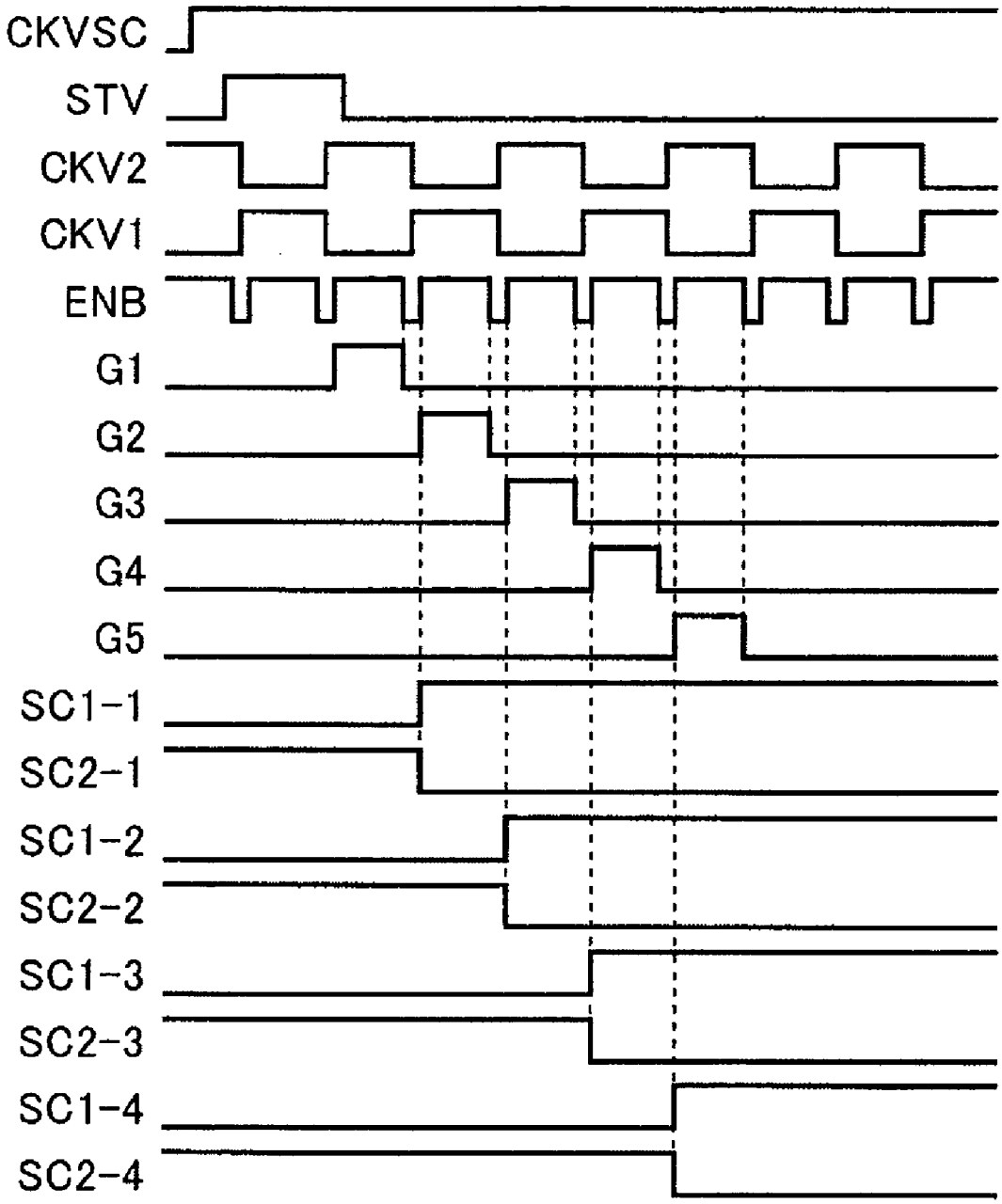
FIG. 2 is a timing chart of the first embodiment of the invention.

FIG. 2 is a timing chart for explaining an operation of the V driver 46 and the potential supply circuit 47 of the liquid crystal display device of the first embodiment. First, a start signal STV of H level is inputted to the V driver 46. Then, a clock signal CKV 1 turns H level in the V driver 46, and thus a signal of H level is inputted from a shift register circuit portion 461*a* (FIG. 3) to an AND circuit portion 462*a*. Then, the clock signal CKV1 turns L level and a clock Signal CKV2 turns H level, so that a signal of H level is inputted from the shift register circuit portion 461*b* to the And circuit portions 462*a* and 462*b*.

Next, the enable signal ENB turns H level, and thus all the three signals (the signals of the shift register circuit portions 461*a* and 461*b* and the enable signal ENB) inputted to the AND circuit portion 462*a* become H level. Therefore, a signal of H level is supplied from the AND circuit portion 462*a* to the gate line G1. Next, the enable signal ENB turns L level, so that a signal of L level is supplied from the AND circuit portion 462*a* to the gate line G1 and the gate line G1 retains L level for one frame period. Then, the clock signal CKV2 turns L level.

Next, the clock signal CKV 1 turns H level again, and thus a signal of H level is inputted from the shift register circuit portion 461*c* to the AND circuit portions 462*b* and 462*c*. Then, the enable signal ENB turns H level again, and thus all the three signals (the signals of the shift register portions 461*b* and 461*c* and the enable signal ENB) inputted to the AND circuit portion 462*b* become H level. Therefore, a signal of H level is supplied from the AND circuit portion 462*b* to the gate line G2. Then, the enable signal ENB turns L level, and thus a signal of L level is supplied from the AND circuit portion 462*b* to the gate line G2 and the gate line G2 retains L level for one frame period. Then, the clock signal CKV1 turns L level.

Next, in similar manners to the AND circuit portions 462*a* and 462*b*, synchronized with the clock signals CKV1 and CKV2, signals of H level from the shift register circuit portions 461*d* to 461*f* are sequentially inputted to the AND circuit portions 462*c* to 462*e*. Thus, in similar manners to the gate lines G1 and G2, synchronized with the enable signals ENB, signals of H level from the AND circuit portions 462*c* to 462*e* are sequentially supplied to the gate lines G3 to G5. Then, synchronized with the enable signals ENB, signals of L level from the AND circuit portions 462*c* to 462*e* are sequentially supplied to the gate lines G3 to G5, and the gate lines G3 to G5 are retained L level for one frame period. It is noted that as shown in FIG. 2 the adjacent gate lines do not have the same H level period since the gate lines G1 to G5 turn L level while the enable signal ENB is being L level.

Furthermore, the AND circuit portions 462*b* to 462*e* for supplying signals to the second or more gate lines sequentially input signals of H level to potential supply circuit portions 47*a* to 47*d*. When inputted with the input signal of H level, a potential supply circuit portion 47*a* supplies a H level potential VSCH to the supplemental capacitance line SC1-1 and a L level potential VSCL to the supplemental capacitance line SC2-1. Even when the input signal to the potential supply circuit portion 47*a* turns L level, the H level potential VSCH and the L level potential VSCL are still supplied to the supplemental capacitance line SC1-1 and the supplemental capacitance line SC2-1 respectively, being retained for one frame period. Then, the potentials supplied to these supplemental capacitance lines are inverted and retained for one frame period again. The potential supply circuit portions 47*b* to 47*d* shown in FIG. 3 also perform the same operation as that of the potential supply circuit portion 47*a*.

In such a manner, the high level potentials VSCH and the low level potentials VSCL from the potential supply circuit portions 47*a* to 47*d* are sequentially supplied to the supplemental capacitance lines SC1-1 to SC1-4 and the supplemental capacitance lines SC2-1 to SC2-4 respectively, at the same timings as the timings of the H level signals supplied to the gate lines G2 to G5.

Figure 3:
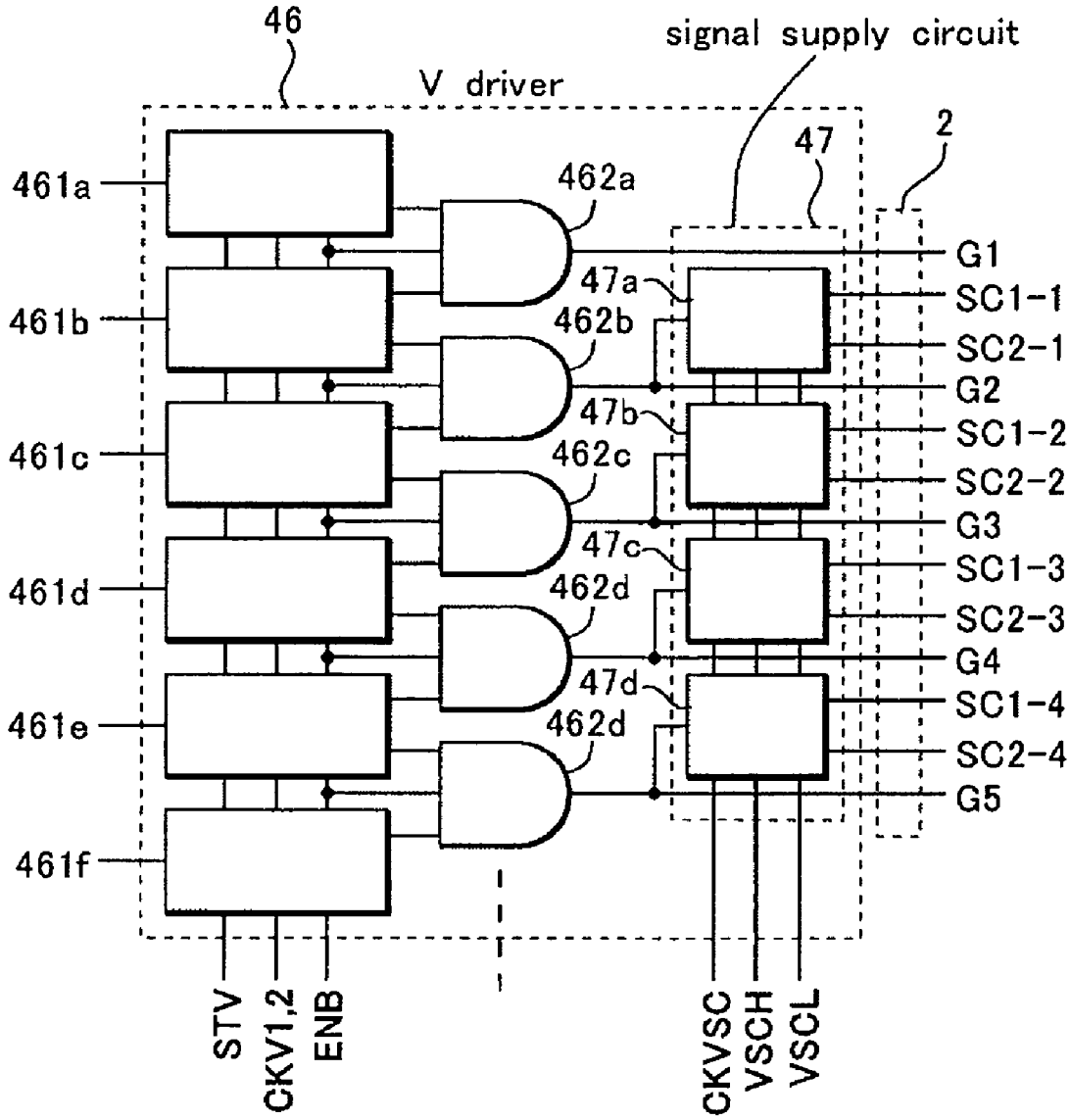
FIG. 3 is a block diagram of a V driver of the first embodiment of the invention.

FIG. 3 is a block diagram of the V driver 46 shown in FIG. 1. The V driver 46 has the shift register circuits portions 461*a* to 461*f*, the AND circuit portions 462*a* to 462*e* each having three input terminals and one output terminal, and the potential supply circuits 47*a* to 47*d*.

The input terminal of the AND circuit portion 462*a* is inputted with the output signals of the shift register circuit portions 461*a* and 461*b* and the enable signal ENB. Each of the AND circuit portions 462*b* and the following AND circuit portions is also inputted with the output signals of the two shift register circuit portions shifted by one portion from the previous shift register circuit portions and the enable signal ENB. The output terminals of the AND circuit portions 462*a* to 462*e* are connected with the gate lines G1 to G5, respectively. The V driver 46 has the potential supply circuit 47 therein, and the potential supply circuit 47 has the potential supply circuit portions 47*a* to 47*d*. The potential supply circuit portions 47*a* to 47*d* are provided corresponding to the gate lines G1 to G4, respectively. The potential supply circuit portion corresponding to the gate line G5 is not shown for simplification of the drawing.

The potential supply circuit portion 47*a* corresponding to G1 is inputted with the output signal of the AND circuit portion 462*b* the output terminal of which is connected with the gate line G2. That is, in this embodiment, the potential supply circuit portion connected with the supplemental capacitance line corresponding to a predetermined gate line is inputted with the output signal of the AND circuit portion the output terminal of which is connected with the next gate line. Furthermore, each of the potential supply circuit portions 47*b* to 47*d* has the same circuit structure as that of the potential supply circuit portion 47*a*.

The supplemental capacitance lines SC1-1 and SC2-1 are connected with the potential supply circuit portion 47*a*, and the supplemental capacitance lines SC1-2 and SC2-2 are connected with the potential supply circuit portion 47*b*. These potential supply circuit portions 47*a* and 47*b* have functions of supplying the H level potential VSCH and the L level potential VSCL to the supplemental capacitance lines SC1-1 and SC2-1, and SC1-2 and SC2-2, respectively, alternately in each of one frame periods. It is noted that one frame period means a period of writing image signals to all the pixel portions forming the display portion 2. The shift register portion 461 has a function of driving the potential supply circuit 47 so as to sequentially supply signals from the potential supply circuit 47 to a pair of the supplemental capacitance lines SC1-1 and SC2-1 along the first gate line G1 to a pair of supplemental capacitance lines (not shown) along the last gate line.

In this embodiment, the potential of the supplemental capacitance line is changed by ΔV after the image signal is inputted to the pixel electrode 34. The potential of the pixel electrode 34, which is at the same potential as the electrode 36 of the supplemental capacitance 33, changes by the amount of $(C_{SC}/C_{ALL})\times\Delta V$, so that a voltage applied between the pixel electrode 34 and the common electrode 35, that is, a voltage applied to the liquid crystal layer, changes. In this embodiment, a display can be made even with an image signal of low potential by using a supplemental capacitance coupling, thereby lowering voltages. It is noted that $C_{ALL}$ means all the capacitance in the pixel, and is a sum of the capacitance $C_{SC}$ of the supplemental capacitance 33, the liquid crystal capacitance $C_{LC}$, and other capacitances in the pixel (e.g. parasitic capacitance).

Figure 4:
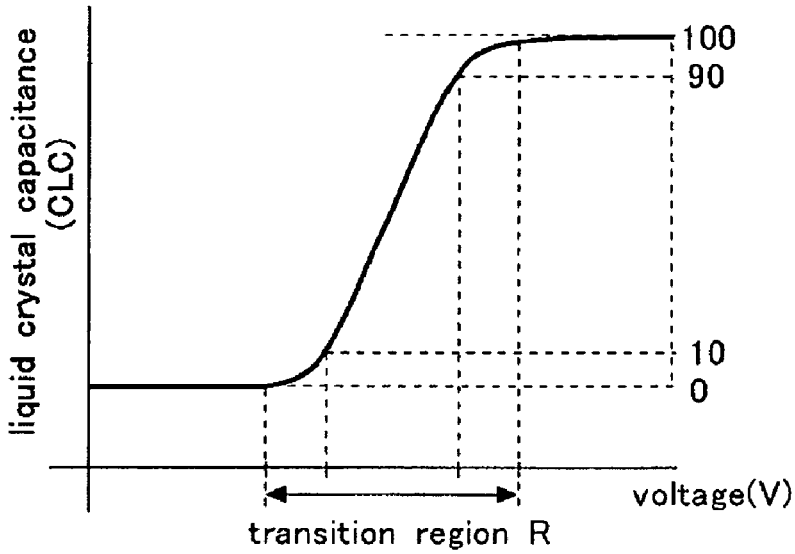
FIG. 4 is a view showing liquid crystal capacitances relative to input voltages.

However, the dielectric constant of the liquid crystal changes when a voltage is applied to the liquid crystal, and thus the liquid crystal capacitance changes. Therefore, even when the potential of the supplemental capacitance line is changed by ΔV, sometimes the potential of the pixel electrode 34 do not change by $(C_{SC}/C_{ALL})\times\Delta V$. This is shown as the liquid crystal capacitance as a function of the voltage (C-V curve) in FIG. 4. That is, the liquid crystal capacitance $C_{LC}$ changes by the change of the potential of the supplemental capacitance line when at least one of voltages of the pixel electrode 34 for the common electrode 35 before or after the potential of the supplemental capacitance line is changed lies within a transition region R. The transition region R is a region of voltages in which the liquid crystal capacitance $C_{LC}$ largely changes. In this case, $C_{LC}$, which is one of components of $C_{ALL}$ of the amount $(C_{SC}/C_{ALL})\times\Delta V$ of potential change of the pixel electrode 34 caused by the potential change of the supplemental capacitance line, changes. Therefore, by correcting the image signal by adding the changing amount of the potential of the pixel electrode 34 using $C_{ALL}$ including the changed $C_{LC}$, a smooth grayscale image can be realized and a high quality display can be obtained. In FIG. 4, it is preferable that the transition region R is set from a voltage starting the change of the liquid crystal capacitance $C_{LC}$ to a voltage ending the change. However, the changing amounts at the start and the end are small and have a little influence on the display, so that the transition region can be set as a range of voltages providing the changing amounts of 10% or more and less than 90%, at least.

Therefore, when at least one of voltages applied to the pixel electrode 34 at the start and end of changing the potential of at least one supplemental capacitance line, preferably a pair of supplemental capacitance lines, more preferably all the supplemental capacitance lines SC1-1, SC2-1, SC1-2, SC2-2 and so on lies within the transition region R, a correction circuit 19 compensates the image signal with $(C_{SC}/C_{ALL})\times\Delta V$ corresponding to the liquid crystal capacitance $C_{LC}$ at the end of the changing. FIG. 1 shows the correction circuit 19 disposed in the substrate 1, but it is preferable that the compensation is performed in the drive IC 9 and so on outride the substrate 1. More preferably, the compensation is performed in a gamma correction circuit (not shown) built in the drive IC 9 and so on.

In the first embodiment, a smooth grayscale display can be obtained by a driving method of changing the potential of the pixel electrode after the image signal is supplied thereto, as described above. This can realize a high quality display and reduce power consumption.

Furthermore, since the potential supply circuit 47 is set in the V driver 46 and the potential supply circuit portions 47*a* to 47*d* are sequentially driven by using signals for sequentially driving the gate lines G2 to G5, a circuit size can be reduced and a yield can be improved.

In the first embodiment, the potential supply circuit portion corresponding to the predetermined gate line is driven by inputting an output signal of the AND circuit portion, the output terminal of which is connected with the next gate line, to the potential supply circuit portion corresponding to the predetermined gate line. Therefore, the output signal from the next shift register circuit portion to the predetermined portion is outputted after the output signal of the shift register circuit portion for driving the predetermined gate line is outputted. Accordingly, either the H level potential VSCH or the L level potential VSCL can be easily supplied to each of the pair of the supplemental capacitance lines corresponding to the predetermined gate line after the completion of writing the image signal to the pixel portions arrayed along the predetermined gate line.

In the conventional driving method, an input voltage to a pixel electrode is almost equal to an effective voltage to the liquid crystal layer. In a driving method using supplemental capacitance coupling in this invention, however, the potential of the pixel electrode itself is changed by changing the potential of the supplemental capacitance line after the image signal is inputted to the pixel electrode, and the liquid crystal capacitance is also changed by the change of the potential of the pixel electrode. Therefore, the input voltage to the pixel electrode is different from the effective voltage applied to the liquid crystal layer, and it is difficult to measure the effective voltage finally applied to the liquid crystal layer although it is possible to calculate the effective voltage. Since a calculated value differs among setting methods of $C_{ALL}$, the accuracy lowers.

Therefore, this embodiment uses a gamma correction circuit performing gamma correction by relying on the relation between an input voltage applied to the liquid crystal layer before the potential of the supplemental capacitance line is changed and a transmittance of the liquid crystal finally obtained after the potential of the pixel electrode is changed using the supplemental capacitance coupling, without using the effective voltage to the liquid crystal. This gamma correction circuit can be provided either inside or outside the substrate. The structure and the driving method thereof are the same as those of the first embodiment.

Figure 5:
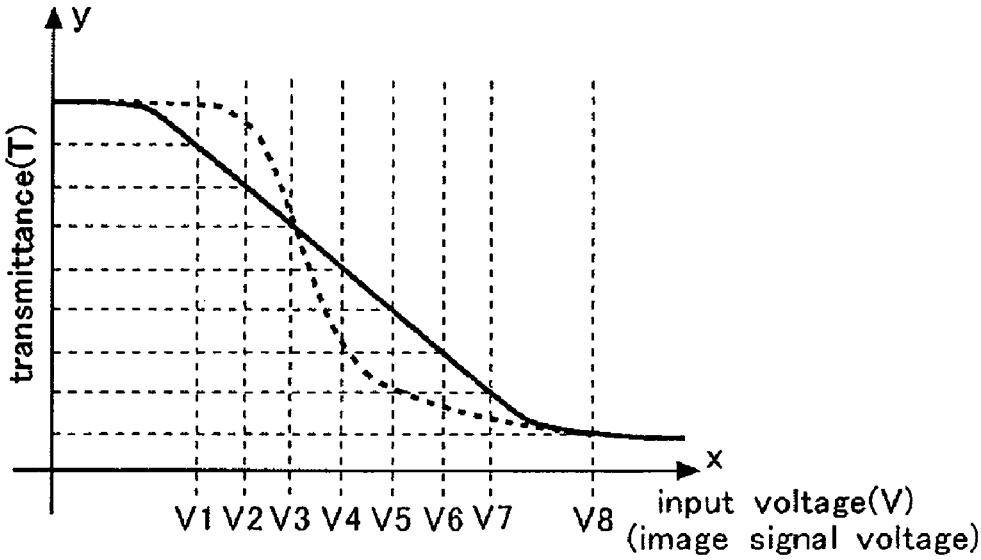
FIG. 5 is a view showing transmittances of a liquid crystal layer relative to input voltages of the first embodiment of the invention.

FIG. 5 shows the transmittance of the liquid crystal as a function of the applied voltage. In FIG. 5, an x axis shows the input voltage for the pixel electrode, and a y axis shows the transmittance of the liquid crystal finally obtained when the potential of the supplemental capacitance line is changed after the signal of the potential of the input voltage is supplied to the pixel electrode. A solid line shows the relation between the input voltage and the transmittance in this embodiment, and a dotted line shows the relation between the input voltage and the transmittance when the conventional driving method is used in a display device using a liquid crystal layer made of the same liquid crystal material as that of the embodiment. In FIG. 5, although the same liquid crystal material is used, a curve in this embodiment is more relaxed. Therefore, by performing gamma correction with the curve shown in FIG. 5, voltage differences between grayscales increase, so that the grayscales can be displayed more accurately and multiple grayscale images can be obtained.

Figure 6:
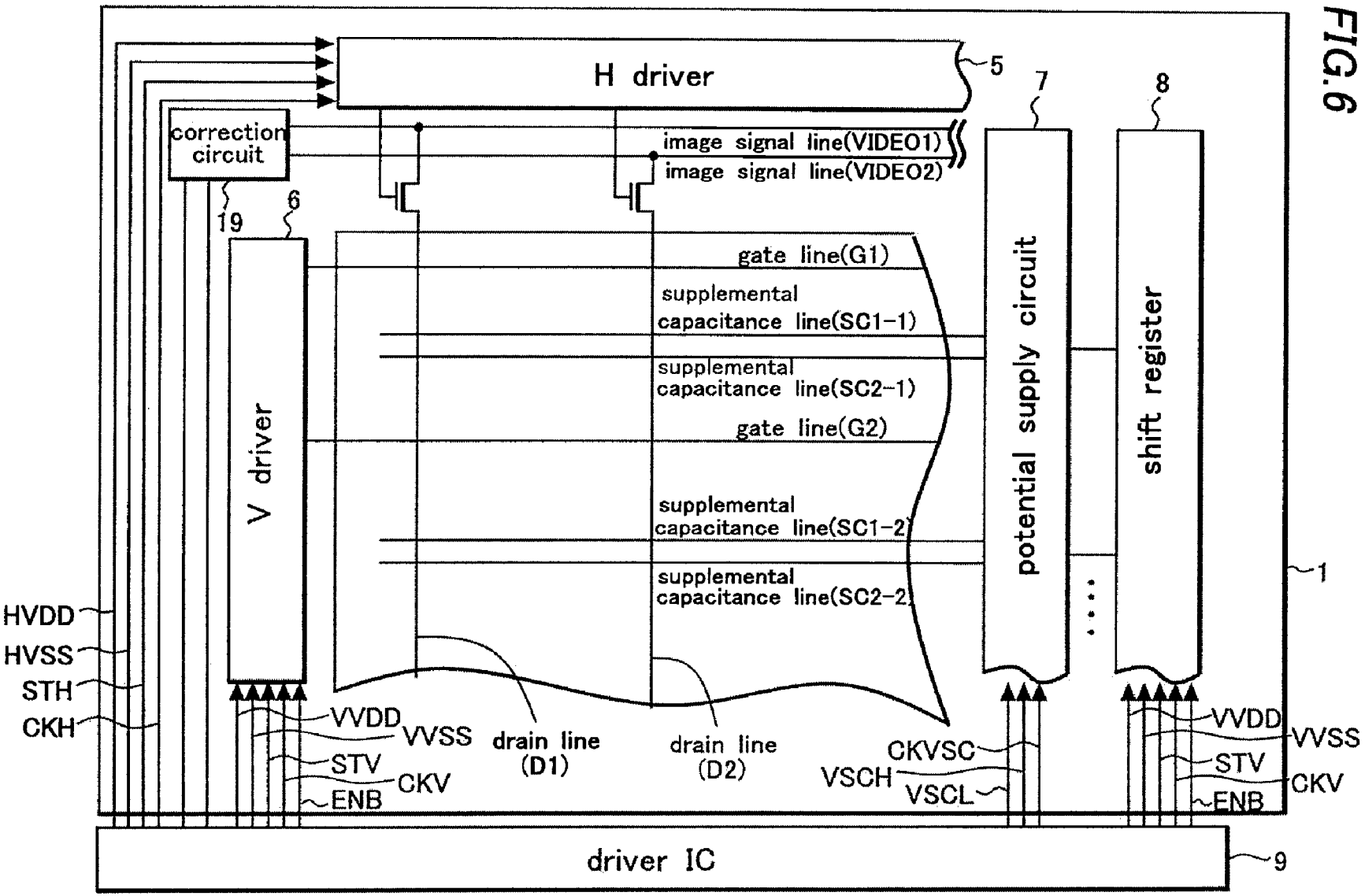
FIG. 6 is a plan view of a liquid crystal display device of another embodiment of the invention.
Figure 7:
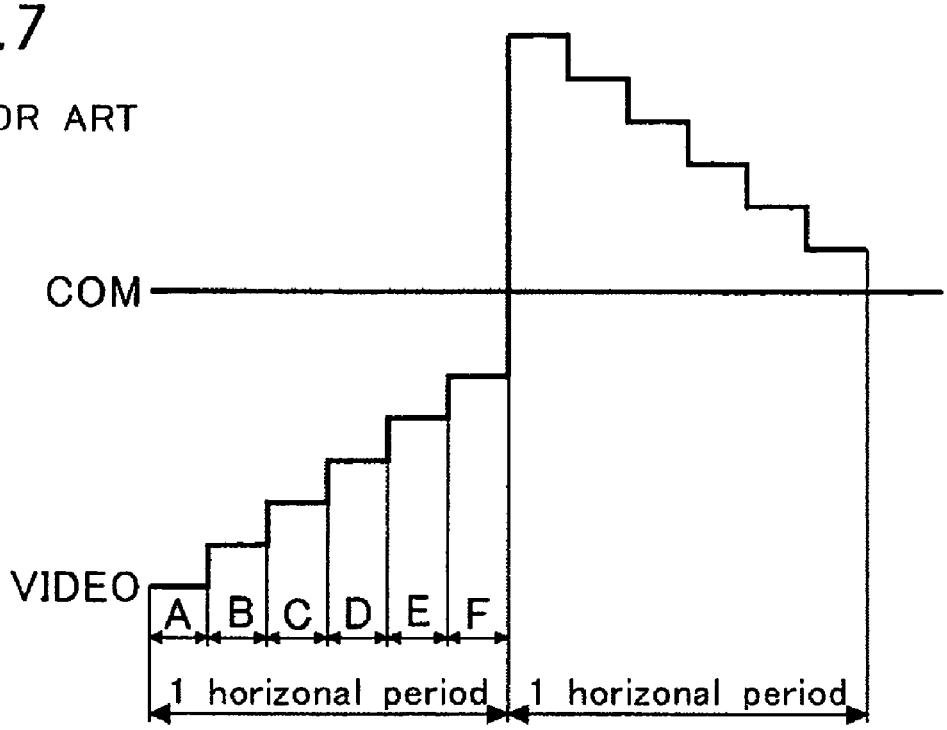
FIG. 7 is a waveform chart in a case where a liquid crystal display device is driven by a conventional line inversion driving method.
Figure 8:
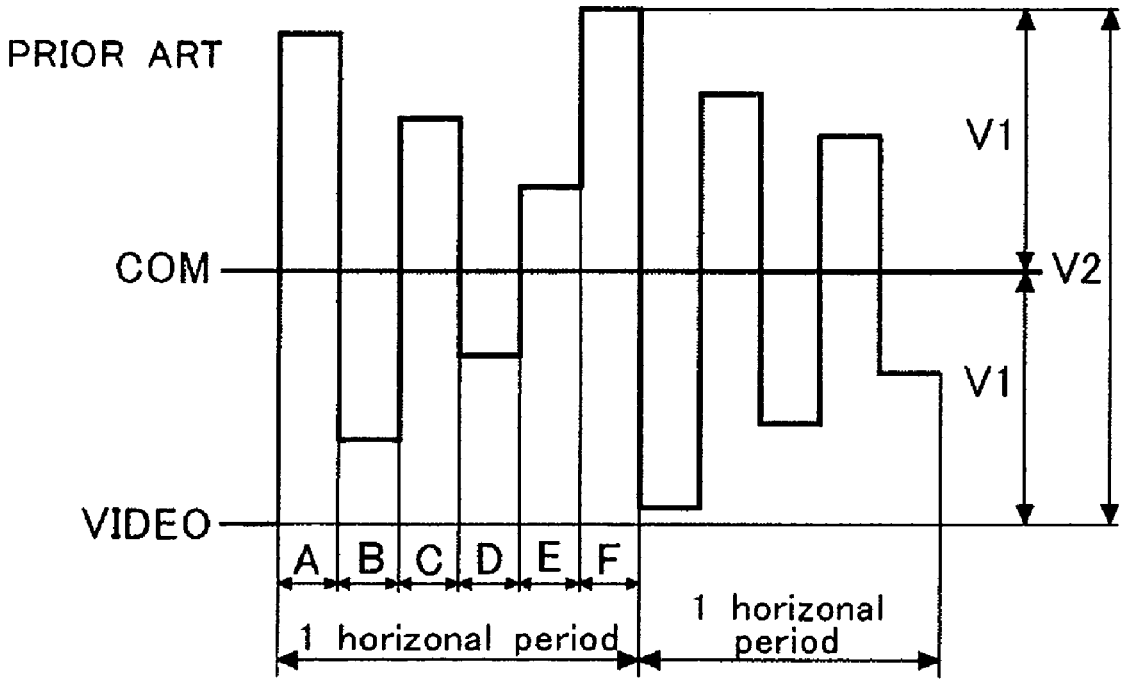
FIG. 8 is a waveform chart in a case where a liquid crystal display device is driven by a conventional dot inversion driving method.
Figure 9:
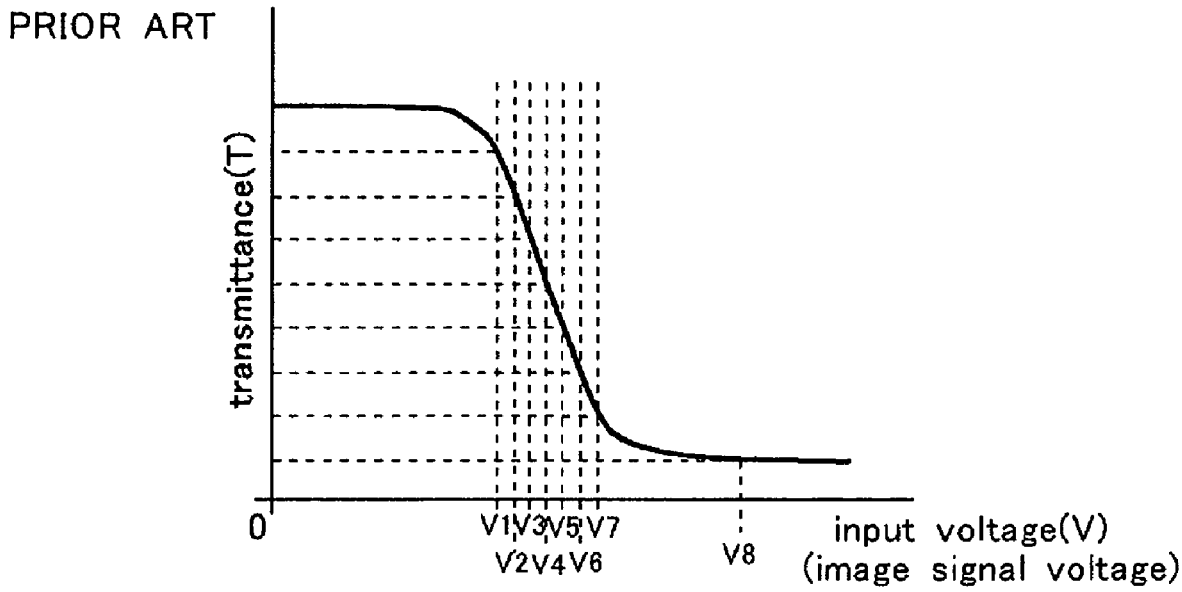
FIG. 9 is a view showing transmittances of a liquid crystal layer relative to input voltages in a case where a liquid crystal display device is driven by a conventional driving method.

This invention is not limited to the above embodiment. For example, another shift register 8 supplying signals to the plurality of supplemental capacitance lines sequentially can be provided as shown in FIG. 6. Although this embodiment shows the case where two image signal lines are provided, the invention can have a structure where one image signal line is provided connecting with all the drain lines.

What is claimed is:

1. A liquid crystal display device comprising:

a plurality of drain lines;

a plurality of gate lines crossing the drain lines;

a plurality of pixel electrodes connected to corresponding drain lines;

a common electrode;

a liquid crystal layer disposed between the pixel electrodes and the common electrode;

a plurality of supplemental capacitors each provided for corresponding pixel electrodes, each of the supplemental capacitors comprising a first electrode connected to a corresponding pixel electrode and a second electrode;

a plurality of supplemental capacitance lines each connected to corresponding second electrodes and configured to receive supplemental voltages; and a correction circuit correcting image signals supplied to the pixel electrodes through the drain lines and the supplemental capacitors when a start voltage that is a voltage of a pixel electrode at a start of receiving a supplemental voltage or an end voltage that is a voltage of the pixel electrode at an end of receiving the supplemental voltage falls within a range of voltage applied to the pixel electrode that corresponds to a change in a capacitance of the liquid crystal layer, the correction circuit correcting the image signals so as to compensate for the change in the capacitance of the liquid crystal layer.

2. The liquid crystal display device of claim 1, wherein the correction circuit corrects the image signals based on an amount of capacitance coupling between one of the pixel electrodes and a corresponding supplemental capacitor that changes during the receiving of the supplemental voltage.

3. The liquid crystal display device of claim 1, further comprising a potential supply circuit portion supplying the supplemental voltages to the supplemental capacitance lines after completion of applying the image signals to the pixel electrodes connected to one of the gate lines.

4. The liquid crystal display device of claim 1, further comprising a gamma correction circuit that comprises the correction circuit.

5. A liquid crystal display device comprising:

a plurality of gate lines;

a first pixel electrode of a first pixel and a second pixel electrode of a second pixel, the first and second pixels being connected to a gate line;

a common electrode;

a liquid crystal layer disposed between the first and second pixel electrodes and the common electrode;

a first supplemental capacitor provided for the first pixel electrode and comprising a first electrode connected to the first pixel electrode and a second electrode;

a second supplemental capacitor provided for the second pixel electrode and comprising a third electrode connected to the second pixel electrode and a fourth electrode;

a first supplemental capacitance line connected to the second electrode and configured to receive a first supplemental voltage, the first supplemental capacitance line not being connected to the fourth electrode;

a second supplemental capacitance line connected to the fourth electrode and configured to receive a second supplemental voltage, the second supplemental capacitance line not being connected to the second electrode; and a correction circuit correcting a first image signal supplied to the first pixel electrode through the first supplemental capacitor when a first start voltage that is a voltage of the first pixel electrode at a start of receiving the first supplemental voltage or a first end voltage that is a voltage of the first pixel electrode at an end of receiving the first supplemental voltage falls within a range of voltage applied to the first pixel electrode that corresponds to a change in a capacitance of the liquid crystal layer, and further correcting a second image signal supplied to the second pixel electrode when a second start voltage that is a voltage of the second pixel electrode at a start of receiving the second supplemental voltage or a second end voltage that is a voltage of the second pixel electrode at an end of receiving the second supplemental voltage falls within a range of voltage applied to the second pixel electrode that corresponds to a change in a capacitance of the liquid crystal layer.

6. The liquid crystal display device of claim 5, wherein the correction circuit corrects the first image signal based on an amount of capacitance coupling between the first pixel electrode and the first supplemental capacitor that changes during the receiving of the first supplemental voltage or corrects the second image signal based on an amount of capacitance coupling between the second pixel electrode and the second supplemental capacitor that changes during the receiving of the second supplemental voltage.

7. The liquid crystal display device of claim 5, wherein the first and second supplemental voltages alternate each other in each of frame periods of the display device.

8. The liquid crystal display device of claim 5, wherein the first pixel electrode and the second pixel electrode are connected to one of the gate lines and disposed adjacent each other.

9. The liquid crystal display device of claim 8, further comprising a potential supply circuit supplying the first and the second supplemental voltages to the first and second supplemental capacitance lines after completion of applying the image signals to the first and second pixel electrodes.

10. The liquid crystal display device of claim 8, wherein the second image signal is an inverted first image signal.

11. The liquid crystal display device of claim 5, wherein pixel electrodes and supplemental capacitors that are identical to the first pixel electrode and first supplemental capacitor are provided to form a first block, pixel electrodes and supplemental capacitors that are identical to the second pixel electrode and second supplemental capacitor are provided to form a second block adjacent the first block, and the second image signal is an inverted first image signal.

12. A liquid crystal display device comprising:

a gate line;

a first pixel electrode and a second pixel electrode that are connected to the gate line;

a common electrode;

a liquid crystal layer disposed between the first and second pixel electrodes and the common electrode;

a first supplemental capacitor provided for the first pixel electrode and comprising a first electrode connected to the first pixel electrode and a second electrode;

a second supplemental capacitor provided for the second pixel electrode and comprising a third electrode connected to the second pixel electrode and a fourth electrode;

a first supplemental capacitance line connected to the second electrode and configured to receive a first supplemental voltage;

a second supplemental capacitance line connected to the fourth electrode and configured to receive a second supplemental voltage;

a potential supply circuit supplying the first supplemental voltage to the first supplemental capacitance line after completion of applying an image signal to the first pixel electrode and supplying the second supplemental voltage to the second supplemental capacitance line after completion of applying another image signal to the second pixel electrode; and a gamma correction circuit performing gamma correction to the image signal or the another image signal based on a transmittance characteristic of the liquid crystal layer observed after the supplying of the first supplemental voltage.

13. A method of controlling a liquid crystal display device, comprising:

providing a liquid crystal display device comprising, a gate line, a first pixel electrode of a first pixel and a second pixel electrode of a second pixel, the first and second pixels being connected to the gate line, a common electrode, a liquid crystal layer disposed between the first and second pixel electrodes and the common electrode, a first supplemental capacitor provided for the first pixel electrode, a second supplemental capacitor provided for the second pixel electrode, a first supplemental capacitance line connected to the first supplemental capacitor and configured to receive a first supplemental voltage, the first supplemental capacitance line not being connected to the second supplemental capacitor, and a second supplemental capacitance line connected to the second supplemental capacitor and configured to receive a second supplemental voltage, the second supplemental capacitance line not being connected to the first supplemental capacitor; correcting a first image signal supplied to the first pixel electrode through the first supplemental capacitor when a first start voltage that is a voltage of the first pixel electrode at a start of receiving the first supplemental voltage or a first end voltage that is a voltage of the first pixel electrode at an end of receiving the first supplemental voltage falls within a range of voltage applied to the first pixel electrode that corresponds to a change in a capacitance of the liquid crystal layer; and correcting a second image signal supplied to the second pixel electrode through the second supplemental capacitor when a second start voltage that is a voltage of the second pixel electrode at a start of receiving the second supplemental voltage or a second end voltage that is a voltage of the second pixel electrode at an end of receiving the second supplemental voltage falls within a range of voltage applied to the second pixel electrode that corresponds to a change in a capacitance of the liquid crystal layer.

14. A method of controlling a liquid crystal display device, comprising:

providing a liquid crystal display device comprising, a gate line, a first pixel electrode and a second pixel electrode connected to the gate line, a common electrode, a liquid crystal layer disposed between the first and second pixel electrodes and the common electrode, a first supplemental capacitor provided for the first pixel electrode, a second supplemental capacitor provided for the second pixel electrode, a first supplemental capacitance line connected to the first supplemental capacitor and configured to receive a first supplemental voltage, and a second supplemental capacitance line connected to the second supplemental capacitor and configured to receive a second supplemental voltage;

supplying the first supplemental voltage to the first supplemental capacitance line after completion of applying an image signal to the first pixel electrode;

supplying the second supplemental voltage to the second supplemental capacitance line after completion of applying another image signal to the second pixel electrode; and performing gamma correction to the image signal or the another image signal based on a transmittance characteristic of the liquid crystal layer observed after the supplying of the first supplemental voltage.

* * * * *